United States Patent [19]

Johne et al.

[11] 4,018,161

[45] Apr. 19, 1977

[54] PRINTING MACHINE WITH SHEET-TRANSFER ARRANGEMENT

[75] Inventors: Hans Johne, Redebeul; Arndt Jentzsch, Coswig; Otfried Rudolph, Dresden, all of Germany

[73] Assignee: VEB Polygraph Leipzig Kombinat fur Polygraphische Maschinen und Ausrustungen, Leipzig, Germany

[22] Filed: Mar. 25, 1975

[21] Appl. No.: 561,676

[52] U.S. Cl. ..... 101/231; 101/410; 271/82

[51] Int. Cl.[2] ..... B41F 21/00

[58] Field of Search ..... 101/230–232, 101/409, 410; 271/82

[56] References Cited

UNITED STATES PATENTS

| | | | |
|---|---|---|---|
| 3,455,547 | 7/1969 | Rudolph et al. | 271/82 |
| 3,463,484 | 8/1969 | Rudolph | 271/82 |
| 3,654,861 | 4/1972 | Rudolph et al. | 101/230 |
| 3,686,771 | 8/1972 | Schone et al. | 101/230 |
| 3,788,639 | 1/1974 | Bru | 101/409 |
| 3,899,970 | 8/1975 | Jurny et al. | 101/409 |

*Primary Examiner*—Edgar S. Burr
*Assistant Examiner*—William Pieprz
*Attorney, Agent, or Firm*—Michael J. Striker

[57] ABSTRACT

A sheet-transfer arrangement is arranged between two printing stations each having a printing roller. The transfer arrangement has a transfer roller provided with a suction gripper system which lifts the trailing edge portion of a sheet travelling on the first printing roller off the surface of the latter. A drive is provided which temporarily advances the suction gripper system relative to the transfer roller circumferentially of the same and in the direction of rotation thereof, in order to cause the trailing edge region of the sheet to bulge away from the first printing roller. A mechanical gripper system is also provided on the transfer roller which receives the trailing edge portion of the sheet from the suction gripper system, pulls the sheet off the first printing roller, turns it and presents it to the second printing roller during the continued rotation of the transfer roller.

4 Claims, 6 Drawing Figures

PRINTING MACHINE WITH SHEET-TRANSFER ARRANGEMENT

BACKGROUND OF THE INVENTION

The present invention relates generally to a printing machine, and more particularly to a printing machine provided with a sheet-transfer arrangement for transferring sheets between printing stations of the machine.

It is known to provide printing machines, particularly multi-color printing machines, with a plurality of printing stations each of which has a printing roller. In order to be able to print in such machines on both sides of a sheet it is necessary to reverse the sheet as it travels from one printing station to the next. For this purpose, a sheet transfer roller is employed which picks the trailing edge of the sheet off the printing roller of one printing unit, and thereupon reverses the sheet side for side as it conveys the sheet to the printing roller of the next printing unit. The engagement of the sheet is effected by a suction gripper system which furnishes the engaged trailing edge of the sheet with a mechanical gripper system. This arrangement is disclosed in GDR Pat. No. 54,703 and is generally satisfactory. However, in case of high-spped operation, for example 8000 sheets per hour or more, and given a certain characteristic of the sheets, it is possible for the sheets to change their proper orientation in this arrangement because the suction gripper system must move the entire sheet relative to the rotation of the printing cylinder from which it picks the sheet up.

SUMMARY OF THE INVENTION

It is, therefore, a general object of the present invention to overcome the aforementioned disadvantage.

More particularly, it is an object of the present invention to provide an improved printing machine wherein this disadvantage cannot occur.

Still more particularly, it is an object of the invention to provide such an improved printing machine in which despite high-speed operation the position and orientation of a sheet being transferred from one printing unit to another will not change.

In keeping with these objects, and with others which will become apparent hereafter, one feature of the invention resides, in a printing machine, in a combination which comprises a first printing station having a first printing roller for printing one side of a sheet which travels with the same. A second printing station is provided having a second printing roller for printing the other side of the same sheet. A sheet transfer roller is located between and cooperates with the first and second printing rollers. Suction gripper means is provided on the transfer roller for lifting a trailing edge portion of the sheet off the first printing roller. Means is provided for temporarily advancing the suction gripper means relative to the transfer roller circumferentially of the same and in the direction of rotation thereof, so as to cause the trailing edge region of the sheet to bulge away from the first printing roller. Mechanical gripper means on the transfer roller receives the trailing edge portion of the sheet from the suction gripper means, so as to pull the sheet off the first printing roller, turn it and present it to the second printing roller during continued rotation of the transfer roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
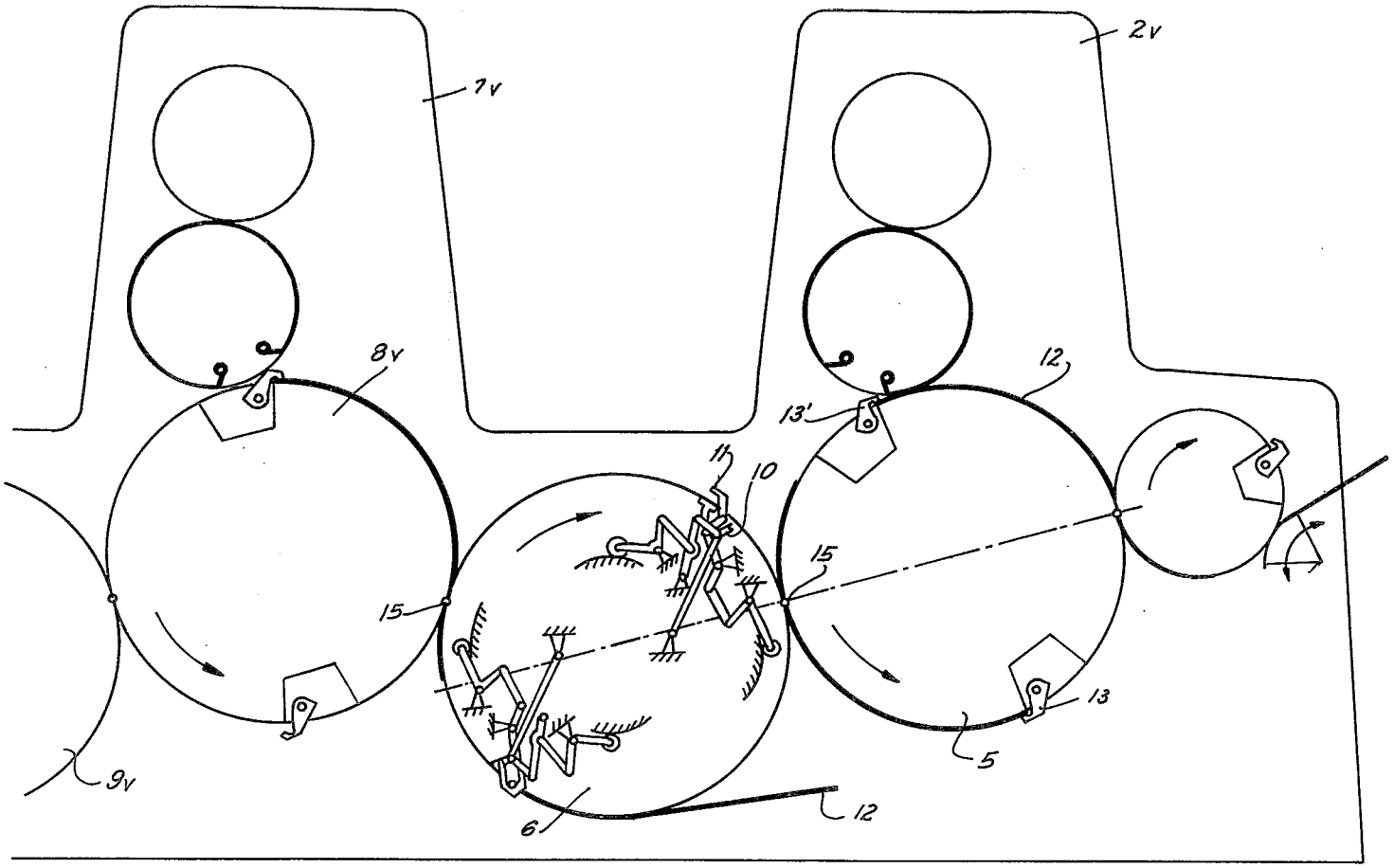
FIG. 1 is a diagrammatic side view illustrating two printing stations of a multi-color printing press.

Referring firstly to FIG. 1, it will be seen that this Figure diagrammatically illustrates two printing units 2 and 7 of a printing press, for example a multi-color rotary printing press. The press has a feed roller which receives sheets to be printed via a feed table 1 and a feeding mechanism 3 which is only diagrammatically illustrated because it does not form a part of the invention. From the feed roller, the sheets, identified with reference numeral 12 (only one shown), are supplied to the printing roller 5 of the first printing unit 2. On this printing roller 5 one side of the respective sheet 12 is printed. No details have been illustrated concerning the cooperating elements of the first printing unit 2, and the same is true of the printing unit 7 where again only the printing roller 8 is illustrated and described. These other details are well known per se.

After having been printed on one side in the first printing unit 2, the sheet 12 is to be printed on its other side in the second printing unit 7. It therefore must not only be advanced to the printing unit 7, but must also be turned side for side so that the previously blank or unprinted side is now available for printing in cooperation with the printing roller 8. Subsequently, the sheet which is now printed on both sides is furnished from the printing roller 8 to a discharge unit 9 which discharges it from the machine.

The transfer of each sheet 12, and its turning side for side, is effected by means of the transfer arrangement which is located between the printing units 2 and 7 and cooperates with the printing rollers 5 and 8. The transfer arrangement has a sheet transfer roller 6 which is provided with two suction gripper systems 10 and mechanical gripper means 11, the roller 5 having two mechanical gripper systems 13 and 13′. Each suction gripper system 10 cooperates with one of the mechanical gripper means 11 and the two suction gripper systems 10 are identical, as are the mechanical gripper means.

The gripper systems 10, 11 all perform movements relative to the roller 6. Since both gripper systems 11 and their associated gripper systems 10 are identical, the description hereafter will be made with reference to one system 11 and its associated system 10, but should be understood to be applicable also to the other two systems.

Figure 5:
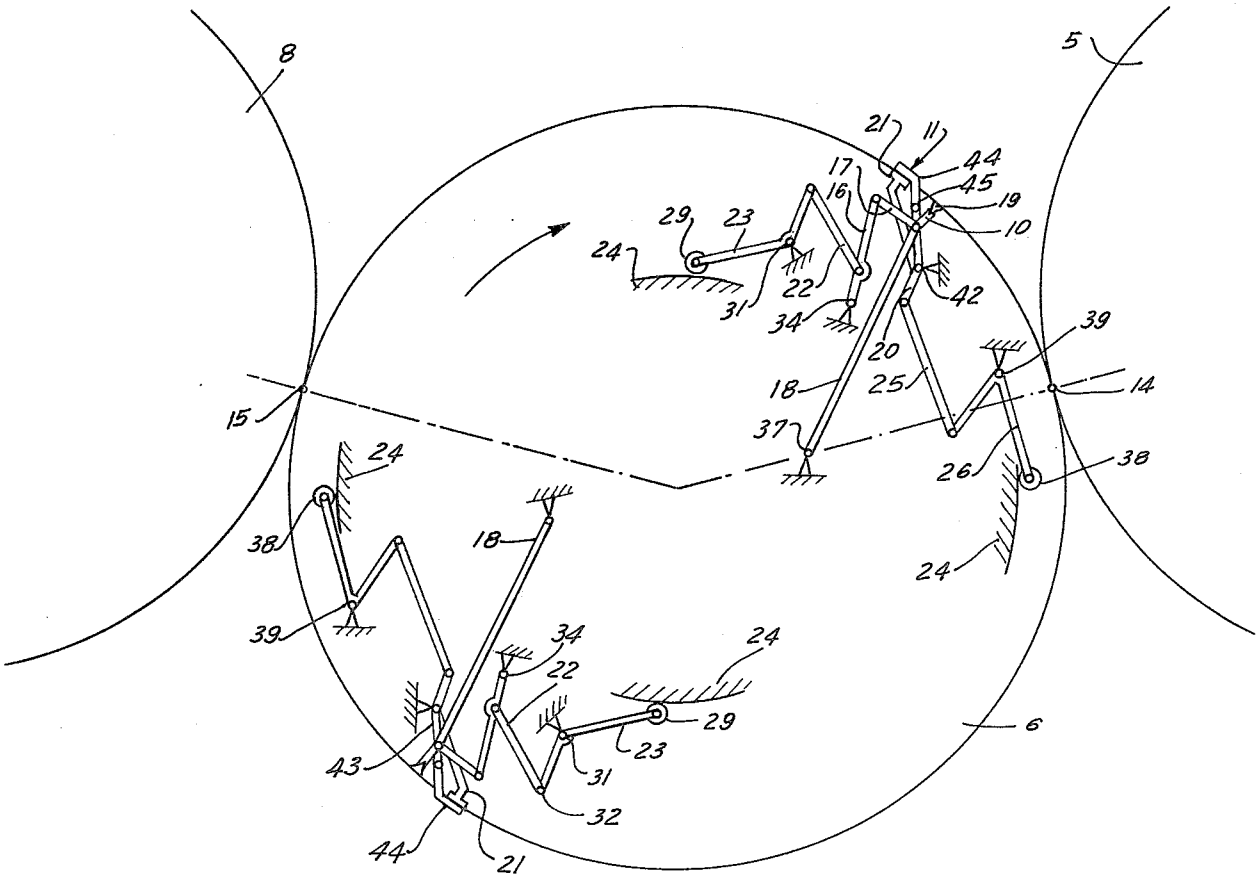
FIG. 5 is a somewhat diagrammatic detail view on an enlarged scale showing the drive components for the gripper systems of the transfer roller in the embodiment of FIGS. 1–4.
Figure 6:
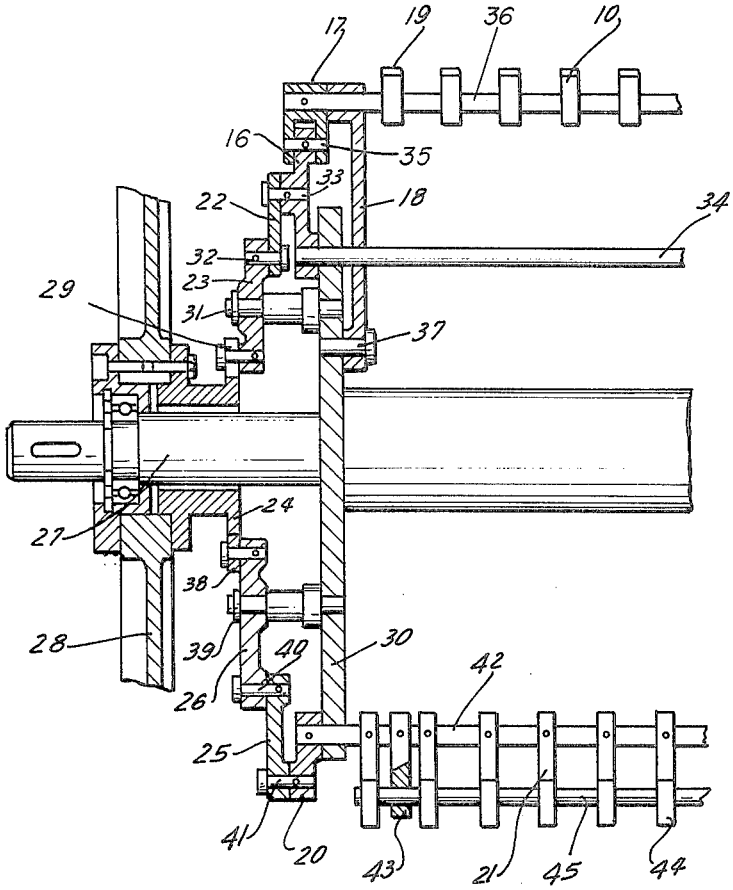
FIG. 6 is a fragmentary section on an enlarged scale through FIG. 5.

The movements of the systems 11 and 10 are effected by a drive arrangement which is shown in more detail in FIGS. 5 and 6. FIG. 6 in particular illustrates a drive arrangement very clearly. It should be understood that only one axial end of the transfer roller 6 is shown in FIGS. 5 and 6; the arrangement at the opposite (not illustrated) axial end of the roller 6 will be identically the same except in a mirror-reversed relationship.

Reference numeral 27 identifies the shaft which mounts the transfer roller 6 for rotation. The shaft is journalled at its opposite axial ends (only one shown) in a wall 28 of the machine frame, so that it can rotate. Fixedly secured to the wall 28, for example by means of screws, is a cam disc 24 which is engaged by a cam follower roller 29 that is mounted on an angular arm 23. A spring (not shown) serves to maintain the roller 29 in engagement with the cam track of the cam 24. The arm 23 is pivotally mounted on a pivot 31 which is fixedly secured in the axial end plate of the roller 6. The cam 24, the follower roller 29 and the arm 23 constitute a drive for a double rocker linkage 16, 17 and 18. The driving connection to the linkage is established by a link 22 which is connected to the arm 23 by a first bolt or pin 32 and with the drive member 16 of the linkage 16–18 by a second bolt or pin 33.

The linkage 16–18 is constructed as follows: one end of the drive member 16 of the linkage is fixedly mounted on a shaft 34 which extends parallel to the shaft 27 and which is journalled for rotation in the end plates 30 (only one shown) of the roller 6; the opposite end of the member 16 is pivotally connected with a link 17 by means of a bolt or pin 35. The link 17, in turn, is fixedly mounted on the hollow suction shaft 36 which carries the suction gripper system 10. The output member 18 of the rocker linkage 16–18 is pivotably mounted on the shaft 36 and its opposite end is pivoted on a pivot 37. A similar linkage 16–18 is provided at the opposite axial end of the roller 6. The drive connection between the linkages takes place via the shaft 34. The suction faces 19 of the suction gripper system 10 extend parallel to the link 17.

A further cam follower roller 38 is provided which is also maintained in engagement with the cam track of the cam 24 by means of a (not illustrated) spring. The roller 38 is mounted on an arm 26 which pivots about a pivot 39. The cam 24 constitutes with the roller 38 and the arm 26 a second drive which is connected with a pivot arm 20 via a link 25. The connection between the arm 26 and the link 25 is via a bolt or pivot 40, and the link 25 is connected with the arm 20 via a bolt or pivot 41.

The arm 20 in turn is fixedly mounted on a swing shaft 42 which is journalled in the end plates 30 of the roller 6 and on which the gripper shaft holders 43 and the gripper abutments 21 are secured. Gripper lugs 44 are mounted on the gripper shaft 45 which is supported by the gripper shaft holders 43.

The shaft 42, the abutments 21, the holders 43, the gripper shaft 45 and the lugs 44 together constitute the mechanical gripper means 11 mentioned earlier.

Details of the construction and operation of such elements as the mechanical gripper systems are not specifically described herein, because they are well within the knowledge of those having ordinary skill in the art. However, reference may be had for further information to U.S. Pat. No. 2,757,610 wherein such details are fully described.

In operation of the apparatus according to the present invention, a sheet 12 is placed onton the feed table 1 from where it is engaged by the feed roller 4 and supplied to the printing roller 5 of the first printing station 2. In this printing station, one side of the sheet 12 is printed. The grippers 13, 13' of the printing roller 5 hold the respective sheet 12 on the circumference of the printing roller 5 and cause it to travel and through the tangent point 15 between the rollers 5 and 6. At the tangent point, the trailing edge portion of the respective sheet 12 is engaged by the suction gripper system 10 of the roller 6. This is the operating stage which is shown in FIG. 2 of the drawing.

Figure 2:
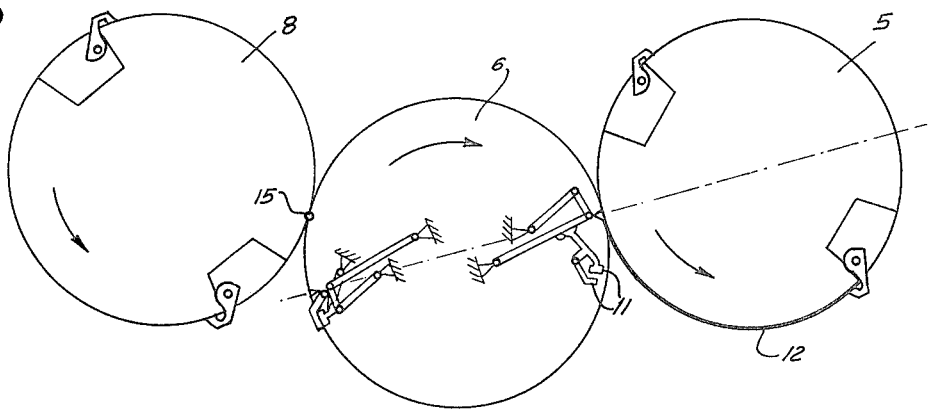
FIG. 2 is a fragmentary diagrammatic detail view showing details of the transfer arrangement of the press in FIG. 1, a first operating position.
Figure 3:
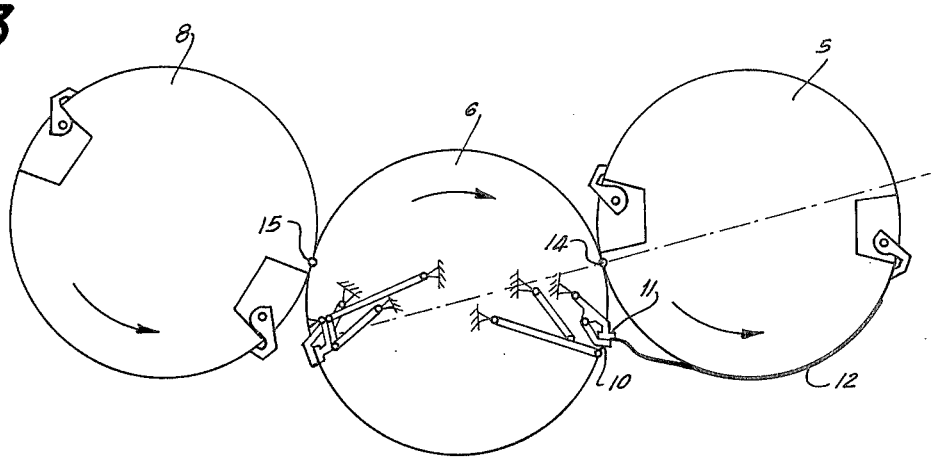
FIG. 3 is a view similar to FIG. 2 showing the arrangement is a second operating position.

Considering FIG. 2 is conjunction with FIGS. 5 and 6, it will be appreciated that as the roller 6 turns, the follower roller 29 follows the cam track of the cam 24, thereby causing the arm 23 to pivot about the first pivot 31, and to operate the link 22 which, in turn, drives the member 16 of the linkage 16–18. As a result of this, the suction gripper system 10 which is carried by the link 17 will be temporarily advanced and accelerated (after it has engaged the trailing edge portion of the sheet 12 on the roller 5) in the direction of rotation of the transfer roller 6. In other words, the system 10 will be briefly accelerated in this direction of rotation beyond the rotary speed of the roller 6. Since the major portion of the sheet 12 is still retained on the periphery of the roller 5, whereas the trailing edge portion of the sheet 12 is engaged by the thus accelerated suction gripper system 10, the sheet 12 is caused to bulge outwardly away from the periphery of the roller 5 at the trailing end region of the sheet. At the same time as this acceleration of the suction gripper system 10 takes place, the link 17 is pivoted together with the suction gripper system 10 to a position relative to the mechanical gripper system 11 in which the latter is able to engage the trailing edge of the sheet 11 from the system 10. This position is shown in FIG. 3.

The mechanical gripper system 11, also is moved in timed relation to the movement of the suction gripper system 10. This movement is imparted to the arm 20 via the roller 38, the arm 26 and the link 25, and causes the arm 20 to perform a relative positional displacement with respect to the suction gripper system 10 to the aforementioned position of FIG. 3 in which the system 11 is able to engage the trailing end of the sheet 12. The abutment faces 21 preferably extend normal to the surface of the roller 6 in this position.

It is advantageous and preferred, but not absolutely necessary, if the path of movement of the system 10 is outside the periphery of roller 6. In the transfer position in which the edge of the sheet 12 is transferred from the system, i.e., before and during the reversal in the direction of movement of the sheet 12 from travel with the roller 5 to travel with the roller 6, the trailing edge of the sheet 12 is engaged both by the system 10 and the system 11. Thereafter, that is once the direction reversal has taken place, the system 10 disengages the trailing edge and the system 11 now continues to advance the sheet 12.

Because the suction gripper system 10 is briefly accelerated to travel faster than the transfer roller 6, thus forming the earlier described outward bulge in the sheet 12 which it has engaged, the suction gripper system 10 need not be able to develop any forces for guiding the sheet 12 and can perform purely the necessary gripping function. The equalization of the bulge in the sheet 12 takes place at a time at which the sheet 12 is already gripped jointly by the systems 10 and 11.

Figure 4:
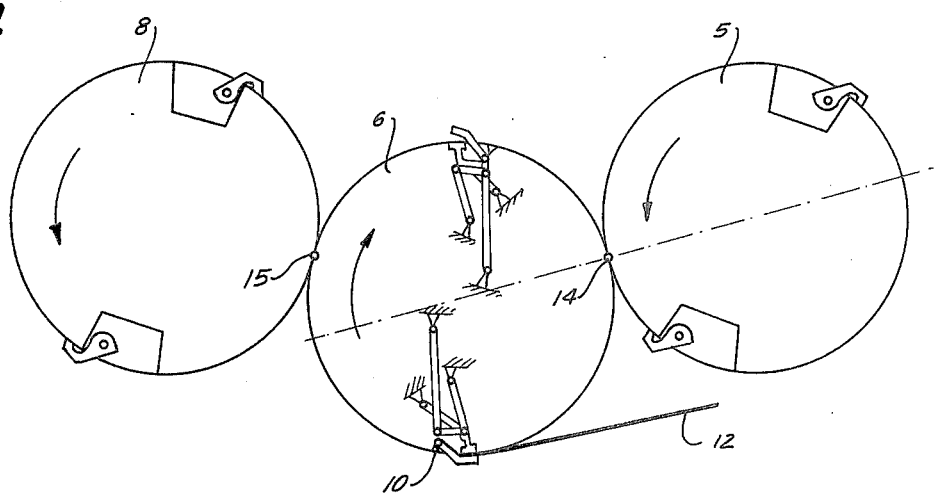
FIG. 4 is a view similar to FIG. 2 showing the arrangement in a third operating position.

After the system 11 has engaged the sheet 12, as shown in FIG. 4, the sheet 12 is transported as known in the art and is ultimately handed over to the gripper system of the second printing cylinder 8, that is the printing cylinder of the station or unit 7.

The controlling of the engagement and disengagement of the sheet 12 by the elements 21 and 44 may be effected by means well known in the art, for example the means disclosed in U.S. Pat. No. 3,463,484.

It will be understood that each of the elements described above, or two or more together, may also find a useful application in other types of constructions differing from the type described above.

While the invention has been illustrated and described as embodied in a printing machine, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing machine, a combination comprising a first printing station having a first printing roller for printing one side of a sheet which travels with the same; a second printing station having a second printing roller for printing the other side of the same sheet; a sheet transfer roller located between and cooperating with said first and second printing rollers; suction gripper means on said transfer roller for lifting a trailing edge portion of the sheet off said first printing roller; means for temporarily advancing said suction gripper means relative to said transfer roller circumferentially of the same and in the direction of rotation thereof along a arcuate path, so as to cause the trailing edge region of the sheet to bulge away from said first printing roller, said advancing means comprising a rocker linkage including a first link member having a free end and another end pivoted at a first location inwardly of the periphery of said transfer roller, a larger second link member also having a free end and another end which is pivoted at a second location inwardly of the periphery of said transfer roller and radially and circumferentially offset from said first location, and a third link member having spaced ends each of which is pivoted to one of said free ends of said first and second link members, said suction gripper means being mounted on said third link member, cam means turnable with said transfer roller and having respective portions which are spaced radially and circumferentially of said transfer roller, and cam follower means operatively associated with said first and second link members and cooperating with the respective cam portions for imparting to each of said first and second link members a part-circular pivoting movement about the respective location, so that said suction gripper means on said third link member moves with said second and third link means relative to said transfer roller in a first curved path in the direction of rotation of the same and also moves relative to said second and third link means in a second curved path, and mechanical gripper means on said transfer roller and operative for receiving said trailing edge portion of said sheet from said suction gripper means prior to disengagement of the latter from said trailing edge portion, and for pulling the sheet after such disengagement off the first printing roller, turning it and presenting it to said second printing roller during continued rotation of said transfer roller.

2. A combination as defined in claim 1, wherein said mechanical gripper means comprises a mechanical gripper unit, and mounting means mounting said mechanical gripper unit for pivoting movement relative to said transfer roller and said suction gripper means.

3. A combination as defined in claim 2, wherein said means mounting said mechanical gripper unit comprises a further cam follower in engagement with said cam means, and a motion-transmitting linkage connected with said gripper unit and with said further cam follower.

4. A combination as defined in claim 1, wherein said suction gripper means has a suction face extending substantially parallel to said third link member.

* * * * *